US011002504B1

(12) United States Patent
Mason et al.

(10) Patent No.: US 11,002,504 B1
(45) Date of Patent: May 11, 2021

(54) VIBRATION DAMPENER FOR ARCHERY BOW

(71) Applicant: Gregory E. Summers, Madison Heights, VA (US)

(72) Inventors: Tristan Mason, Madison Heights, VA (US); Gregory E. Summers, Amherst, VA (US)

(73) Assignee: Gregory E. Summers, Madison Heights, VA (US)

( * ) Notice: Subject to any disclaimer, the term of this patent is extended or adjusted under 35 U.S.C. 154(b) by 0 days.

(21) Appl. No.: 16/705,692

(22) Filed: Dec. 6, 2019

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
USPC ..... 124/89
See application file for complete search history.

(56) References Cited

U.S. PATENT DOCUMENTS 5,735,257 A * 4/1998 Walk ..... F41B 5/1426 124/89
6,076,514 A * 6/2000 Adams, Jr. ..... F41B 5/1426 124/89
6,494,196 B2 * 12/2002 Harwath ..... F41B 5/1426 124/89
6,526,957 B1 * 3/2003 Leven ..... F41B 5/1426 124/89
6,718,964 B1 * 4/2004 Graf ..... F41B 5/1426 124/89
D514,654 S * 2/2006 Sims ..... F41B 5/1426 D21/573
7,703,449 B2 * 4/2010 Wright ..... F41B 5/1426 124/89
7,793,645 B2 * 9/2010 Walk ..... F41B 5/1426 124/89
7,958,881 B2 * 6/2011 Silverson ..... F41B 5/1426 124/86
D662,168 S * 6/2012 Sims ..... F41B 5/1426 D22/107
D692,976 S * 11/2013 Sims ..... F41B 5/1426 D22/107
8,893,700 B2 * 11/2014 Kozlik ..... F41B 5/1426 124/89
9,016,268 B2 4/2015 Leven
9,360,271 B1 * 6/2016 McPherson ..... F16F 7/108
9,383,158 B1 * 7/2016 Khoshnood ..... F41B 5/1426
9,459,068 B2 * 10/2016 Sims ..... F41B 5/1426
9,766,033 B2 9/2017 Powell
(Continued)

*Primary Examiner* — Alexander R Niconovich
(74) *Attorney, Agent, or Firm* — Leading Edge Law Group, PLC

(57) ABSTRACT

A vibration dampener for an archery bow is formed as an elastomeric member having an outer surface containing a plurality of spaced grooves which define ribs there between. Each groove has a constant depth, but the grooves toward the ends of the member are not as deep as the grooves progressing toward the center of the member. The ribs may contain spaced and aligned depressions which cooperate with the grooves to absorb vibrations from the bow in three dimensions during execution of an archery shot. Inserts are provided in each end of the dampener to stabilize the ends and to facilitate connection of the dampener with a bow stabilizer and weights.

9 Claims, 4 Drawing Sheets

(56) References Cited

U.S. PATENT DOCUMENTS

| | | | | |
|---|---|---|---|---|
| 2003/0159684 | A1* | 8/2003 | Donovan | F41B 5/1426 124/89 |
| 2003/0226556 | A1* | 12/2003 | Leven | F16F 7/108 124/89 |
| 2009/0223502 | A1* | 9/2009 | Bach | F41B 5/1426 124/87 |
| 2010/0031946 | A1* | 2/2010 | LoRocco | F41B 5/1426 124/89 |
| 2010/0319670 | A1* | 12/2010 | Sims | F41B 5/1426 124/89 |
| 2011/0259313 | A1* | 10/2011 | Reinhold | F41B 5/1426 124/89 |
| 2011/0265778 | A1* | 11/2011 | Bach | F41B 5/1419 124/92 |
| 2012/0125308 | A1* | 5/2012 | Khoshnood | F41B 5/1426 124/89 |
| 2012/0125309 | A1* | 5/2012 | Khoshnood | F41B 5/1426 124/89 |
| 2012/0125310 | A1* | 5/2012 | Khoshnood | F41B 5/1426 124/89 |
| 2013/0055998 | A1* | 3/2013 | LoRocco | F41B 5/1426 124/89 |
| 2015/0034063 | A1* | 2/2015 | Bidigare | F41B 5/1426 124/89 |
| 2019/0234702 | A1* | 8/2019 | Kelly | F16F 7/10 |

* cited by examiner

VIBRATION DAMPENER FOR ARCHERY BOW

BACKGROUND OF THE DISCLOSURE

Professional archers often use a stabilizer with their bow to improve their accuracy. Similarly, hunters may use a stabilizer as well. A stabilizer is typically screwed into an accessory hole on the bow, whether it be a compound or an Olympic bow. The stabilizer resists torque and absorbs vibrations in the bow when shot, thereby reducing the shock felt in the archer's hand on the bow grip. It also helps keep the bow balanced and settles the archer's arm during aiming.

To further dampen vibrations, a vibration dampener is often connected with the stabilizer.

BRIEF DESCRIPTION OF THE PRIOR ART

Vibration dampeners for archery bows are known in the patented prior art as shown in U.S. Pat. Nos. 9,016,268 and 9,766,033. For example, U.S. Pat. No. 9,016,268 discloses an adjustable mechanical vibration limiting and absorbing device including spaced groups of resilient washers arranged in a cylindrical housing. An exterior weight is operable to compress the washers so that they expand against an inner surface of the housing to absorb vibrations.

While the prior vibration dampeners operate satisfactorily, they are limited to the amount of vibration that can be absorbed. This also limits the range of vibrations that can be reduced and absorbed. The present invention was developed in order to provide improved vibration dampening capabilities in three dimensions over that available with conventional dampeners.

SUMMARY OF THE INVENTION

Accordingly, it is a primary object of the invention to provide a vibration dampener for an archery bow including a cylindrical elastomeric member having a longitudinal axis and an outer surface containing a plurality of spaced annular grooves coaxial with the longitudinal axis. At least one groove intermediate the ends of the elastomeric member has a greater depth than the grooves at the ends of the member to absorb vibrations from the bow in three dimensions.

The grooves are preferably equally spaced along the length of the elastomeric member and the depth of the grooves progressively increases from groove to groove in the direction toward the center of the elastomeric member.

The outer surface of the elastomeric member contains a plurality ribs between the grooves. The ribs contain a plurality of spaced depressions around the circumference of the member. The depressions in the ribs are aligned in the axial direction of the member.

A pair of inserts are molded within each end of the elastomeric member. Each insert contains a threaded opening which extends to an external end surface of the elastomeric member for connection with a bow stabilizer and with weights according to the preferences of the archer. Each insert further includes a flange extending radially from the threaded opening, and the flanges contain a plurality of spaced openings having axes which are parallel to the longitudinal axis of the elastomeric member. During molding of the member, elastomeric material fills the openings and prevents the inserts from being displaced relative to the elastomeric member when the dampener is in use.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
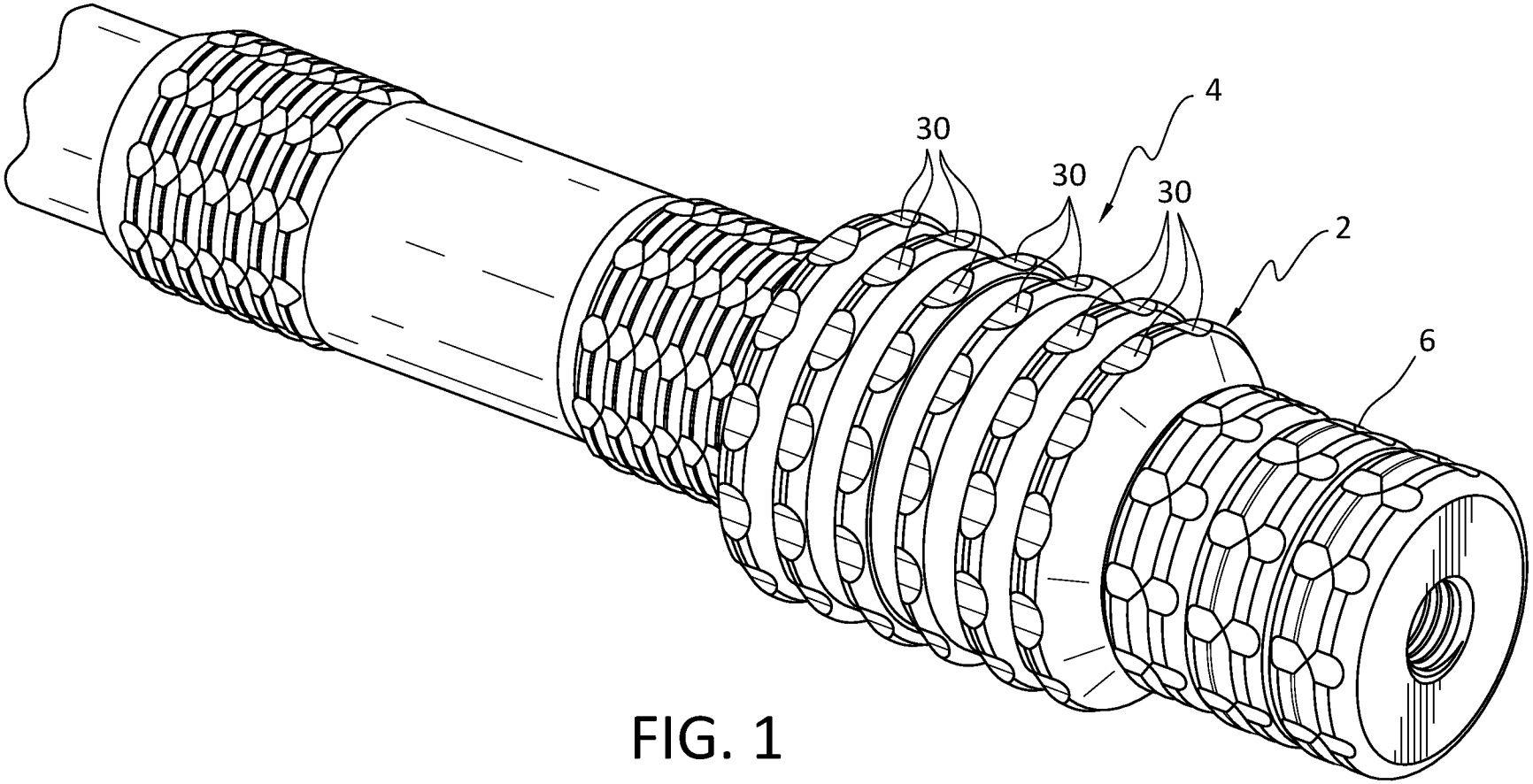
FIG. 1 is a front perspective view of a vibration dampener mounted on an archery bow stabilizer according to the disclosure.
Figure 5:
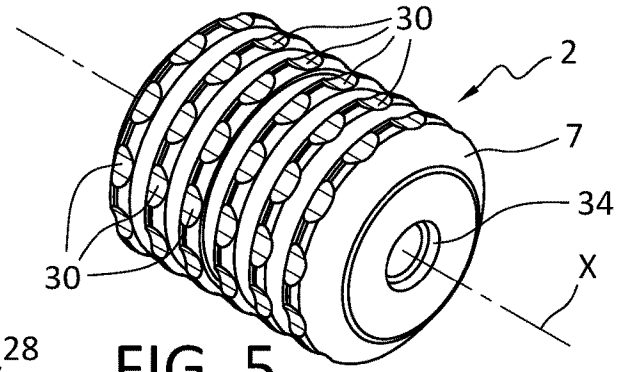
FIGS. 5, 6, 7, and 8 are top right, top left, bottom right and bottom left perspective views, respectively of the dampener of FIG. 2.
Figure 3:
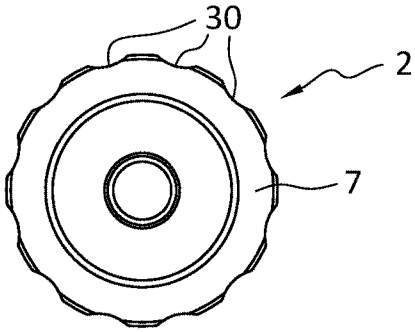
FIGS. 3 and 4 are right and left side elevation views, respectively, of the dampener of FIG. 2.
Figure 7:
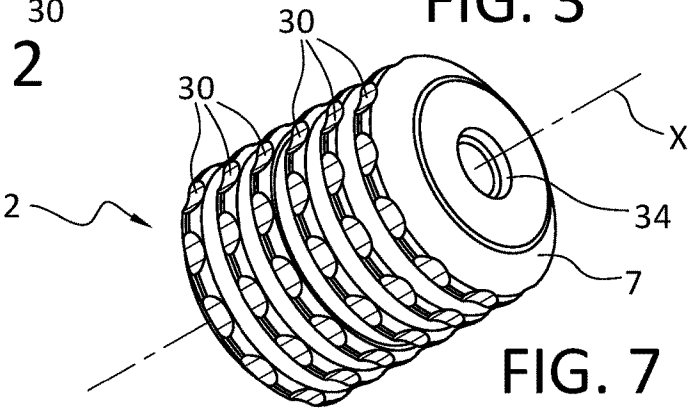
Figure 2:
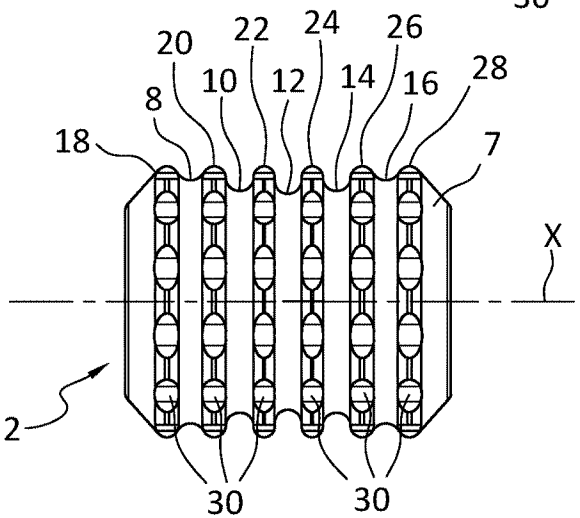
FIG. 2 is a front elevation view of the dampener of FIG. 1.
Figure 6:
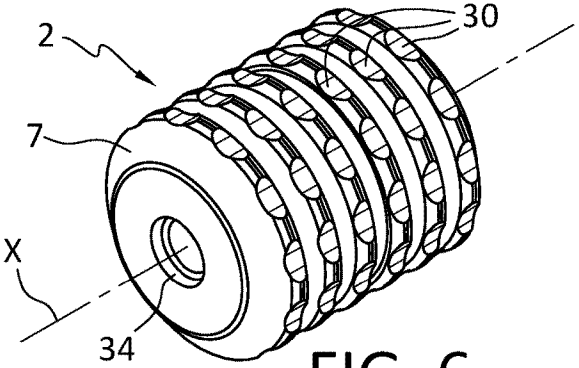
Figure 4:
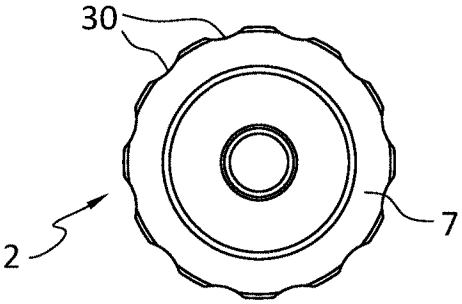
Figure 8:
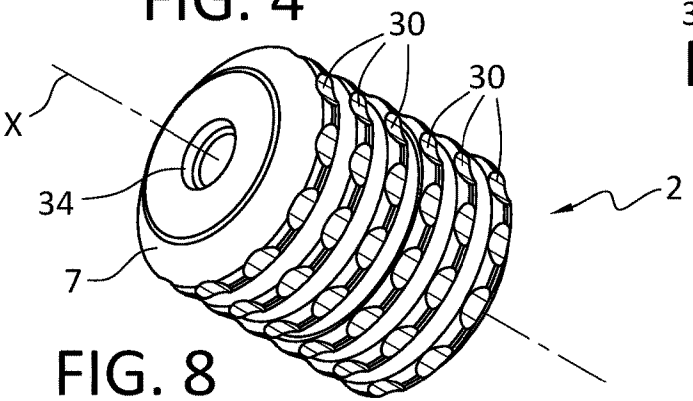

A vibration dampener 2 for an archery bow stabilizer 4 is shown in FIG. 1. The dampener is mounted on the stabilizer, typically via a screw connection. A plurality of annular weights 6 may also be mounted on the stabilizer adjacent to one or both ends of the dampener. The dampener will be described in more detail in connection with FIGS. 2-10.

The vibration dampener is preferably configured as a molded cylindrical member 7 having a longitudinal axis X as shown in FIGS. 2 and 5-9. The member is formed of a material capable of absorbing vibrations. A suitable elastomeric material is rubber, but other synthetic materials which are capable of absorbing vibrations are usable as well. The material has a certain degree of flexure which allows the members to be compressed when pressure is applied and then return to its natural configuration when pressure is released.

The outer surface of the elastomeric member 7 contains a plurality of spaced grooves 8, 10, 12, 14, 16 which extend continuously around the circumference of the member. In the embodiment shown, five grooves are provided. However, it will be appreciated by those of ordinary skill in the art that any number of grooves may be provided. Each groove has a consistent depth and the grooves are coaxial with longitudinal axis X of the member. The grooves are preferably equally spaced along the length of the member.

Figure 9:
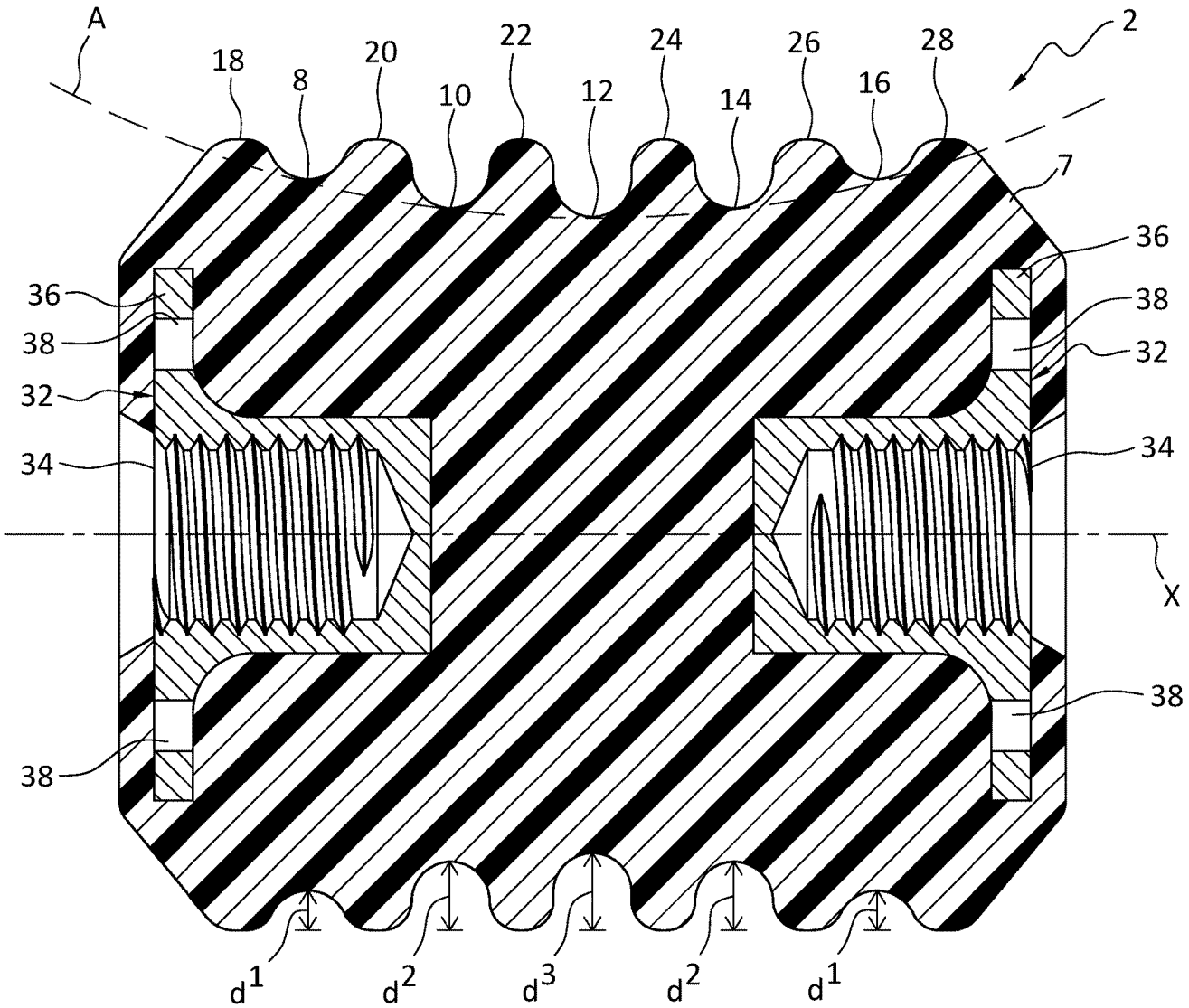
FIG. 9 is a sectional view of the dampener of FIG. 2 taken along its longitudinal axis.

As shown more particularly in FIG. 9, the grooves 8 and 16 toward the ends of the member have a depth $d_1$ while the groove 12 toward the center of the member has a depth $d_3$, with the depth $d_3$ being greater than the depth $d_1$. According to a preferred embodiment of the invention, the grooves 10 and 14 between the center groove 12 and the end grooves 8 and 16 have a depth $d_2$ which is greater than the depth $d_1$ but less than the depth $d_3$. Thus, the depth of the grooves progressively increases from groove to groove in the direction toward the longitudinal center of the member. As shown in FIG. 9, the progressively changing depth defines an arc A that passes through a plane passing through the bottom of each groove and through the longitudinal axis of the member. The flexure of the dampener is thus greater in the middle of the elastomeric member in the region with grooves of the greatest depth. The dampener becomes progressively stiffer toward the ends of the member.

The elastomeric member with grooves of different depths as described above affords absorption of vibrations in three dimensions: along the axis X of the member, laterally within the member, and radially from the member axis. This superior dampening effect increases the overall vibration absorption of the elastomeric member.

The grooves in the outer surface of the member define ribs 18, 20, 22, 24, 26, 28 at the ends of the member and between the grooves. The ribs each contain a plurality of depressions 30 as shown in FIGS. 1 and 5-8 which are spaced around the circumference of the member. The depressions within the ribs are aligned in the axial direction of the member. That is, the depressions are arranged in longitudinally extending spaced rows in the outer surface of the member. The depth of the depressions is preferably the same. The accordion style rings with depressions around the circumference of the elastomeric member results in a dampener that expels vibration more effectively.

Figure 10:
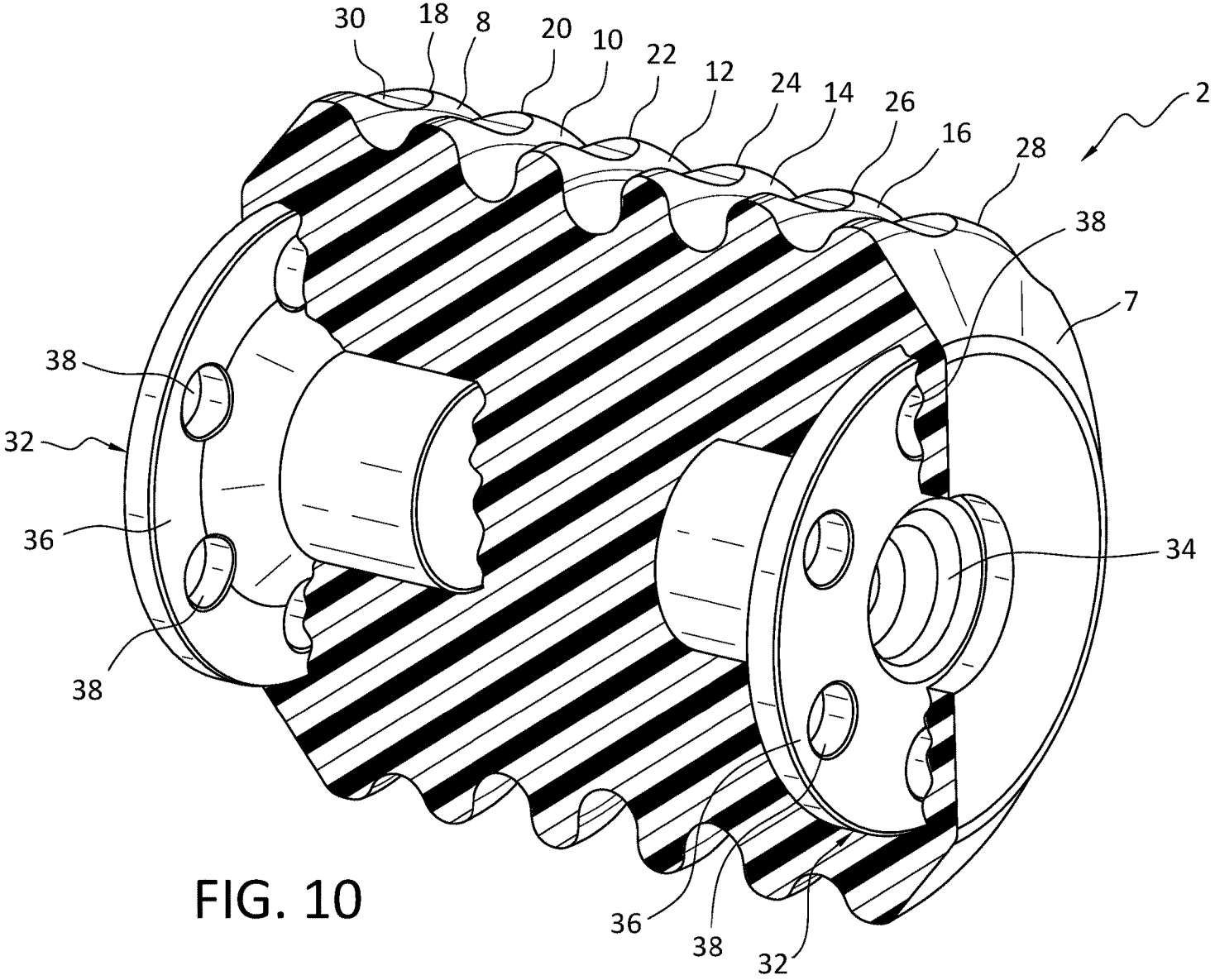
FIG. 10 is a partial sectional perspective view of the dampener of FIG. 2.

Referring now to FIGS. 9 and 10, the elastomeric member 7 preferably includes a pair of inserts 32 which are molded in each end of the member. The inserts are preferably formed of a lightweight rigid material such as a metal or synthetic plastic. Aluminum is an example of a suitable metal. Each insert contains a threaded opening 34 which extends to an external end surface of the elastomeric member. The threaded openings extend coaxially with the longitudinal axis X of the member and facilitate connection with the bow stabilizer and/or the weights. The inserts include a flange 36 which extends radially from the threaded end. As shown in FIG. 9, the flange is embedded within the member adjacent the ends thereof. This provides additional structural stability to the ends of the member which are stiffer than the central or middle region. The flanges contain a plurality of spaced openings 38 having axes parallel to the longitudinal axis of the member. During molding of the member with the inserts positioned as shown in FIGS. 9 and 10, elastomeric material enters the openings so that the inserts are encapsulated by the material, but for the threaded openings which extend to the end surfaces of the member as shown in FIGS. 5-8 and 10. After molding of the member, the elastomeric material within the flange openings prevents the inserts from being rotated or otherwise displaced relative to the member when the dampener is in use.

While the preferred forms and embodiments of the vibration dampener have been illustrated and described, it will be apparent to those of ordinary skill in the art that various changes and modifications may be made without deviating from the novel concepts thereof.

What is claimed is:

1. A vibration dampener for an archery bow, comprising a cylindrical elastomeric member having a longitudinal axis and a constant diameter, an outer surface of said elastomeric member containing a plurality of spaced annular grooves coaxial with said longitudinal axis, a groove intermediate each end of said elastomeric member and having a depth relative to said outer surface greater than a depth of said grooves at the ends of said elastomeric member, whereby when said vibration dampener is connected with an archery bow stabilizer, vibrations from the bow are dampened in three dimensions.

2. A vibration dampener as defined in claim 1, wherein the depth of said grooves progressively increases from groove to groove in a direction toward a center of said elastomeric member.

3. A vibration dampener as defined in claim 2, wherein said grooves are equally spaced along a length of said elastomeric member.

4. A vibration dampener as defined in claim 1, wherein said outer surface of said elastomeric member contains a plurality of ribs between said grooves, said ribs containing a plurality of spaced depressions around a circumference of said elastomeric member, said depressions of said ribs being aligned in an axial direction of said elastomeric member.

5. A vibration dampener as defined in claim 4, wherein said depressions have the same depth.

6. A vibration dampener as defined in claim 1, and further comprising a pair of inserts molded within each end of said elastomeric member, respectively.

7. A vibration dampener as defined in claim 6, wherein each insert contains a threaded opening which extends to an external end surface of said elastomeric member, each threaded opening extending coaxial with said elastomeric member.

8. A vibration dampener as defined in claim 7, wherein each insert includes a flange extending radially from said threaded opening, said flange containing a plurality of spaced openings having axes parallel to said longitudinal axis, whereby when said inserts are molded within said elastomeric member, elastomeric material enters said openings and prevents said inserts from being displaced relative to said elastomeric member when the vibration dampener is in use.

9. A vibration dampener as defined in claim 8, wherein said inserts are formed of at least one of a lightweight metal and composite rigid material.

* * * * *